US009199481B2

(12) United States Patent
Yoshida

(10) Patent No.: US 9,199,481 B2
(45) Date of Patent: Dec. 1, 2015

(54) IMAGE FORMING APPARATUS CONFIGURED TO PERFORM EXPOSURE CONTROL AND EXPOSURE METHOD

(75) Inventor: Shingo Yoshida, Osaka (JP)

(73) Assignee: KYOCERA Document Solutions Inc. (JP)

( * ) Notice: Subject to any disclaimer, the term of this patent is extended or adjusted under 35 U.S.C. 154(b) by 464 days.

(21) Appl. No.: 13/569,459

(22) Filed: Aug. 8, 2012

(65) Prior Publication Data

US 2013/0038671 A1 Feb. 14, 2013

(30) Foreign Application Priority Data

Aug. 11, 2011 (JP) ..... 2011-175549
Aug. 11, 2011 (JP) ..... 2011-175550

(51) Int. Cl.
*B41J 2/47* (2006.01)
*G03G 15/043* (2006.01)

(52) U.S. Cl.
CPC ..... *B41J 2/473* (2013.01); *G03G 15/0435* (2013.01)

(58) Field of Classification Search
CPC ..... B41J 2/442; B41J 2/45; B41J 2/455; B41J 2/471
USPC ..... 347/131, 240, 253
See application file for complete search history.

(56) References Cited

U.S. PATENT DOCUMENTS

| | | | | |
|---|---|---|---|---|
| 7,003,241 | B1 * | 2/2006 | Kobayashi et al. | 399/72 |
| 2007/0115339 | A1 | 5/2007 | Matsuzaki et al. | |
| 2010/0226672 | A1 | 9/2010 | Ogasahara | |
| 2013/0229696 | A1 * | 9/2013 | Takikawa et al. | 358/474 |

FOREIGN PATENT DOCUMENTS

| | | | | |
|---|---|---|---|---|
| JP | 58-028733 | | 2/1983 | |
| JP | 61108256 | | 5/1986 | |
| JP | 61108256 | A * | 5/1986 | H04N 1/23 |
| JP | 04-200065 | | 7/1992 | |
| JP | 2001260413 | | 9/2001 | |
| JP | 2001298618 | | 10/2001 | |
| JP | 2005-96086 | | 4/2005 | |

OTHER PUBLICATIONS

European Search Report—Jul. 17, 2014.

* cited by examiner

*Primary Examiner* — Kendrick Liu
(74) *Attorney, Agent, or Firm* — Gerald E. Hespos; Michael J. Porco; Matthew T. Hespos

(57) ABSTRACT

The data conversion unit of an image forming apparatus converts input image data into dot image data in which pixel values having gradation information are arranged in a matrix. A storage unit stores optical face tangle error information of each reflecting surface of a rotary polyhedron. An assignment unit assigns a number to each of the plurality of reflecting surfaces, specifies by which of the plurality of reflecting surfaces light emitted for each line of the dot image data is to be reflected and assigns the number of the reflecting surface to each line of the dot image data. A determination unit determines a light emission mode corresponding to the dot image data based on the optical face tangle error information and the number of the reflecting surface. An exposure control unit causes the light source to emit light in accordance with the determined emission mode.

4 Claims, 11 Drawing Sheets

IMAGE FORMING APPARATUS CONFIGURED TO PERFORM EXPOSURE CONTROL AND EXPOSURE METHOD

INCORPORATION BY REFERENCE

This application is based on Japanese Patent Application Serial No. 2011-175549 filed with the Japan Patent Office on Aug. 11, 2011 and Japanese Patent Application Serial No. 2011-175550 filed with the Japan Patent Office on the same date, the contents of which are hereby incorporated by reference.

BACKGROUND

The present disclosure relates to an image forming apparatus which forms an electrostatic latent image on an image bearing member by scanning light emitted from a light source in a main scanning direction of the image bearing member using a rotary polyhedron.

An electrophotographic image forming apparatus forms an electrostatic latent image on a photoconductive drum by reflecting light emitted from a light source by a polygon mirror (rotary polyhedron) being driven and rotated and scanning it in a main scanning direction of the image bearing member. The polygon mirror has a plurality of reflecting surfaces formed of reflecting mirrors and reflects light by each reflecting surface to scan the rotating photoconductive drum in the main scanning direction. At this time, if the inclination of each reflecting surface with respect to a rotary shaft of the polygon mirror is equal, pitches between lines drawn by the respective reflecting surfaces (line pitches in a sub scanning direction which is a rotating direction of the photoconductive drum) are constant.

However, pitches between lines drawn by the respective reflecting surfaces of the polygon mirror may vary due to a variation of the inclination of the respective reflecting surfaces with respect to the rotary shaft (optical face tangle error) such as caused by a variation of processing accuracy and vibration associated with high-speed rotation of the polygon mirror. As a result, pitches between horizontal lines in a formed image vary in the case of using image data composed of a plurality of horizontal lines at equal intervals. Thus, there has been a problem of being unable to obtain an image with good quality.

As a conventional technology, there is known a method for correcting an optical face tangle error in a main scanning direction while specifying reflecting surfaces of a polygon mirror. However, this method is effective in aligning writing positions in the main scanning direction, but cannot correct line shifts in a sub scanning direction, wherefore it has not been possible to suppress image quality deterioration.

An object of the present disclosure is to provide an image forming apparatus and an exposure method capable of suppressing quality deterioration of a formed image even when an optical face tangle error of a rotary polyhedron is present.

SUMMARY

An image forming apparatus according to one aspect of the present disclosure includes an image bearing member on the circumferential surface of which an electrostatic latent image is to be formed, a data conversion unit, a light source, a deflecting mechanism, a storage unit, an assignment unit, a determination unit and an exposure control unit.

The data conversion unit converts input image data into dot image data in which pixel values having gradation information are arranged in a matrix. The light source emits light modulated according to the pixel values for each line of the dot image data to form the electrostatic latent image on the circumferential surface of the image bearing member. The deflecting mechanism includes a rotary polyhedron having a plurality of reflecting surfaces and a driving member for driving and rotating the rotary polyhedron and scans the light emitted from the light source in a main scanning direction on the circumferential surface of the image bearing member by driving and rotating the rotary polyhedron by the driving member. The storage unit stores optical face tangle error information of each reflecting surface of the rotary polyhedron. The assignment unit assigns a number to each of the plurality of reflecting surfaces, specifies by which of the plurality of reflecting surfaces light emitted for each line of the dot image data is to be reflected and assigns the number of the reflecting surface to each line of the dot image data. The determination unit determines a light emission mode corresponding to the dot image data based on the optical face tangle error information and the number of the reflecting surface. The exposure control unit causes the light source to emit light in accordance with the determined emission mode.

An exposure method according to another aspect of the present disclosure is for forming an electrostatic latent image on the circumferential surface of an image bearing member using a rotary polyhedron having a plurality of reflecting surfaces for reflecting light emitted from a light source and includes the following processes (A) to (E).

(A) Image data is converted into dot image data in which pixel values having gradation information are arranged in a matrix.

(B) A number is assigned to each of the plurality of reflecting surfaces, by which of the plurality of reflecting surfaces light emitted for each line of the dot image data is to be reflected is specified and the number of the reflecting surface is assigned for each line of the dot image data.

(C) Optical face tangle error information of each reflecting surface of the rotary polyhedron is obtained.

(D) A light emission mode corresponding to the dot image data is determined based on the optical face tangle error information and the number of the reflecting surface.

(E) The light source is caused to emit light in accordance with the determined emission mode and the light emitted by the light source is scanned in a main scanning direction on the circumferential surface of the image bearing member by rotating the rotary polyhedron.

These and other objects, features and advantages of the present disclosure will become more apparent upon reading the following detailed description along with the accompanying drawings.

DETAILED DESCRIPTION

Hereinafter, embodiments of the present disclosure are described with reference to the drawings.

First Embodiment

Figure 1:
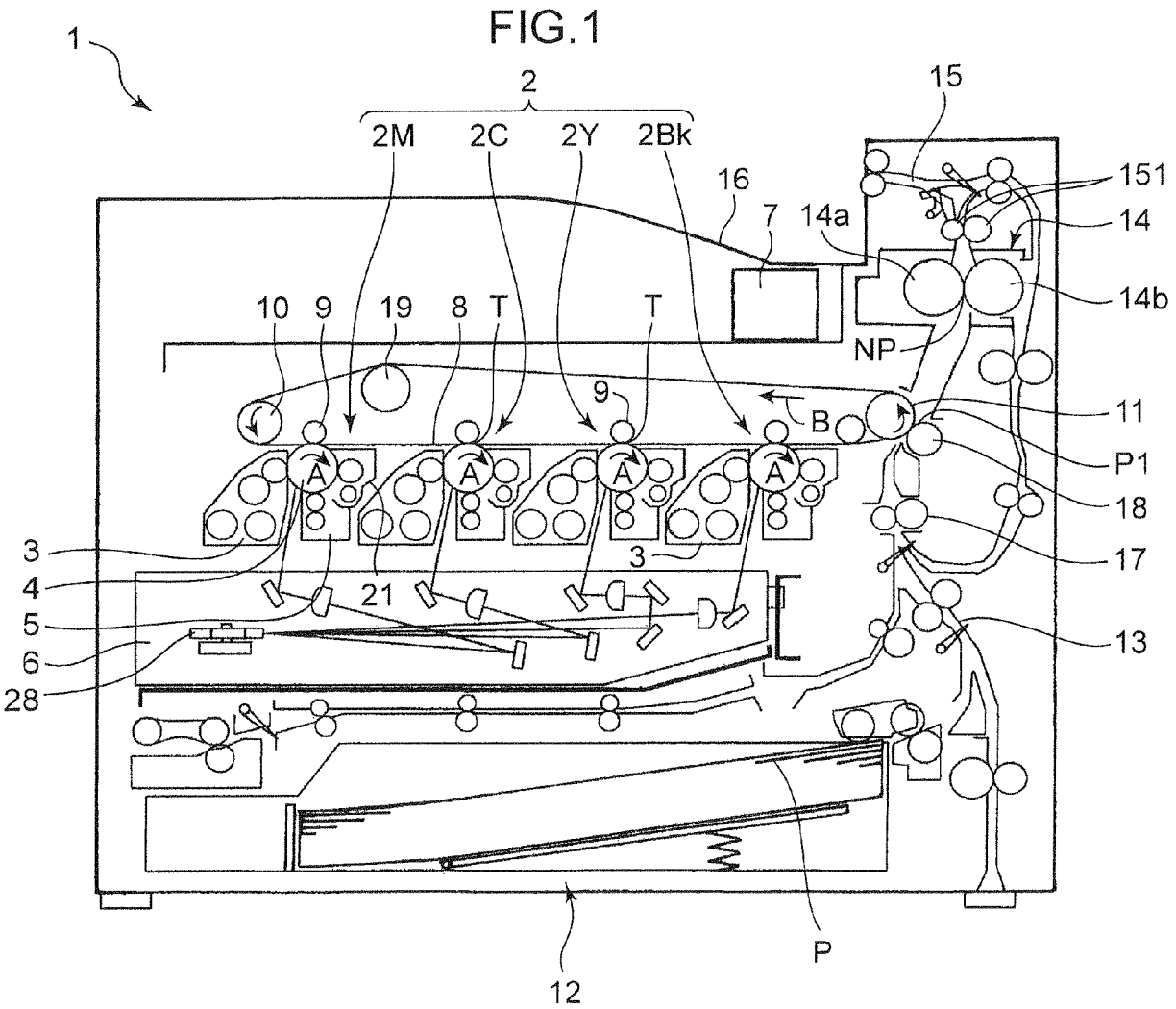
FIG. 1 is a schematic diagram of the internal configuration of an image forming apparatus according to one embodiment of the present disclosure.

FIG. 1 is a schematic diagram of the internal configuration of an image forming apparatus according to the present disclosure. Note that although the image forming apparatus is described, taking a printer as an example in this embodiment, it only has to be an image forming apparatus adopting an electrophotographic method such as a copier, a facsimile machine and a complex machine provided with these functions besides the printer. Further, although the image forming apparatus described in this embodiment is a color printer, it may be a black-and-white printer.

The image forming apparatus 1 is a tandem color printer including image forming units 2 (2M, 2C, 2Y and 2Bk) for each of magenta (M), cyan (C), yellow (Y) and black (Bk). Each of the image forming units 2M, 2C, 2Y and 2Bk includes a developing device 3, a photoconductive drum 4 (image bearing member), a charger 5, an exposure device 6, a toner supply unit 7, a cleaner 21 and a primary transfer roller 9.

The photoconductive drum 4 bears an electrostatic latent image and a toner image on the circumferential surface thereof. The photoconductive drum 4 is arranged below a transfer belt 8 to be described later with the circumferential surface thereof held in contact with the outer surface of the transfer belt 8. The photoconductive drum 4 for magenta, the photoconductive drum 4 for cyan, the photoconductive drum 4 for yellow and the photoconductive drum 4 for black are arranged side by side from an upstream side in a rotating direction B of the transfer belt 8. The photoconductive drum 4 is a drum including an a-Si (amorphous silicon) layer and rotates in a clockwise direction (shown direction A) in FIG. 1.

The primary transfer roller 9 is arranged to face the photoconductive drum 4 via the transfer belt 8 while being held in contact with the inner surface of the transfer belt 8. The primary transfer roller 9 is a roller driven and rotated by the rotation of the transfer belt 8 and nips the transfer belt 8 together with the photoconductive drum 4, thereby forming a primary transfer unit T for primarily transferring a toner image of each color formed on the circumferential surface of the photoconductive drum 4. In the primary transfer units T, toner images of the respective colors are transferred in a superimposition manner. In this way, a full-color toner image is formed on the transfer belt 8.

The charger 5 uniformly charges the circumferential surface of the photoconductive drum 4. The exposure device 6 includes a polygon mirror 28 (rotary polyhedron) for guiding a light beam based on image data transmitted from an external apparatus to the circumferential surface of the photoconductive drum 4. The polygon mirror 28 forms an electrostatic latent image on the circumferential surface of each photoconductive drum 4 by scanning the light beam in a main scanning direction on the circumferential surface of the photoconductive drum 4 while being rotated by a motor 32 (driving member) to be described later. That is, a deflecting mechanism is formed by the polygon mirror 28 and the motor 32. Note that the main scanning direction is a direction in which the light beam is scanned in a longitudinal direction of the photoconductive drum 4. The polygon mirror 28 is shared among a plurality of photoconductive drums 4.

The toner supply unit 7 stores toners of respective colors of magenta, cyan, yellow and black. The developing device 3 supplies the toner supplied from the toner supply unit 7 to the circumferential surface of the photoconductive drum 4. In this way, the toner adheres to an electrostatic latent image and a toner image is formed on the circumferential surface of the photoconductive drum 4. The cleaner 21 is arranged on the circumferential surface of each photoconductive drum 4 to remove residual toner and the like on the circumferential surface.

The transfer belt 8 is arranged above a row of the photoconductive drums 4 and so mounted between a driven roller 10 and the drive roller 11 that the outer surface thereof is held in contact with the circumferential surfaces of the photoconductive drums 4. Further, the transfer belt 8 is biased upwardly by a tension roller 19. The drive roller 11 rotates upon receiving a drive force from an unillustrated drive source and drives and rotates the transfer belt 8. The driven roller 10 is driven and rotated by the rotation of the transfer belt 8. In this way, the transfer belt 8 is rotated in a direction B (counterclockwise direction).

Further, the transfer belt 8 is bent at a part mounted on the drive roller 11. This bent part is set as a secondary transfer position P1 where a toner image primarily transferred to the transfer belt 8 is secondarily transferred to a sheet P. A secondary transfer roller 18 facing the drive roller 11 via the transfer belt 8 is disposed at this secondary transfer position P1. A nip is formed between the secondary transfer roller 18 and the drive roller 11, and a toner image on the outer surface of the transfer belt 8 is secondarily transferred to a sheet P passing the nip.

A pair of registration rollers 17 are arranged below the secondary transfer position P1. The registration rollers 17 convey a sheet P toward the secondary transfer position P1 at an appropriate timing and corrects the oblique feed of the sheet P.

A fixing device 14 for applying a fixing process to a sheet P having a toner image secondarily transferred at the secondary transfer position P1 is provided above the secondary transfer position P1. The fixing device 14 includes a heating roller 14*a* and a pressure roller 14*b*, and a fixing nip portion NP is formed by this pair of rollers. When a sheet P passes the fixing nip portion NP, the pressure roller 14*b* presses the sheet P while the heating roller 14*a* heats the sheet P, whereby the secondarily transferred toner image is fixed onto the sheet P.

A sheet cassette 12 for storing a stack of sheets is arranged at a position below the exposure device 6. A sheet conveyance path 13 for guiding a sheet P from the sheet cassette 12 to the secondary transfer position P1 is provided between the sheet cassette 12 and the secondary transfer position P1. The above registration rollers 17 are arranged in the sheet conveyance path 13. In addition to the registration rollers 17, a plurality of pairs of conveyor rollers for guiding the sheet P are arranged at suitable positions in the sheet conveyance path 13.

The heating roller 14*a* and the pressure roller 14*b* convey a sheet P having passed through the fixing nip portion NP toward a pair of discharge rollers 151. A discharge portion 16 to which the sheet P having a fixing process applied thereto by the fixing device 14 is discharged is formed on the upper surface of the image forming apparatus 1. A sheet discharge path 15 for guiding a sheet P is provided between the discharge portion 16 and the fixing device 14. The sheet P is conveyed to the sheet discharge path 15 by driving the pair of discharge rollers 151 and discharged to the discharge portion 16.

Figure 2:
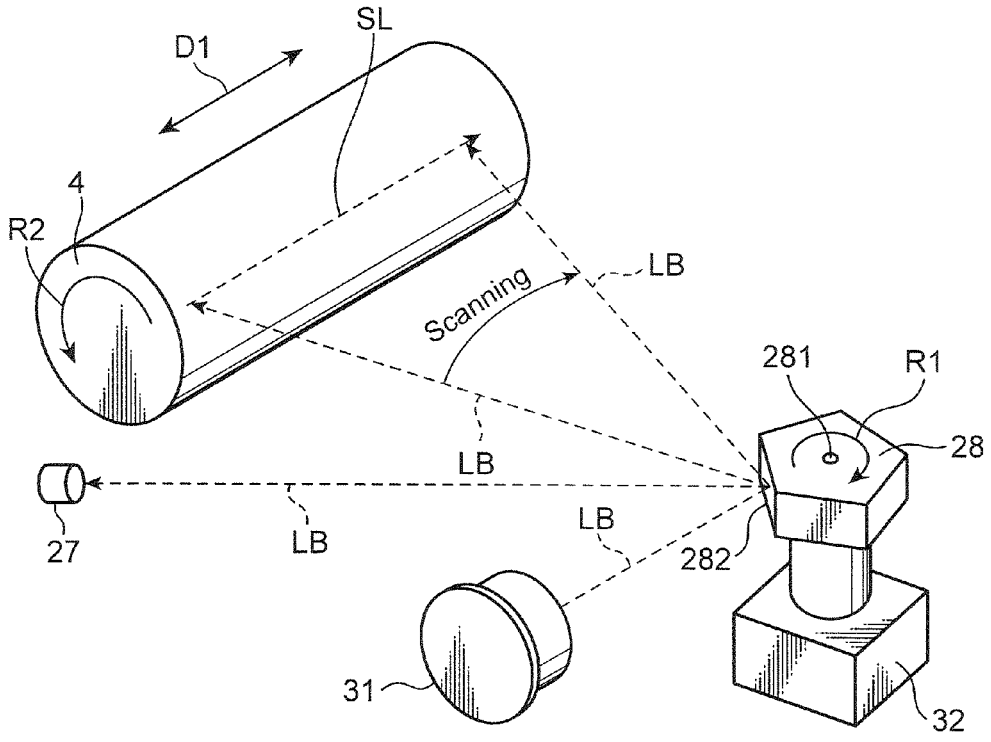
FIG. 2 is a diagram showing a state where a light beam is irradiated to a reflecting surface of a polygon mirror.
Figure 3:
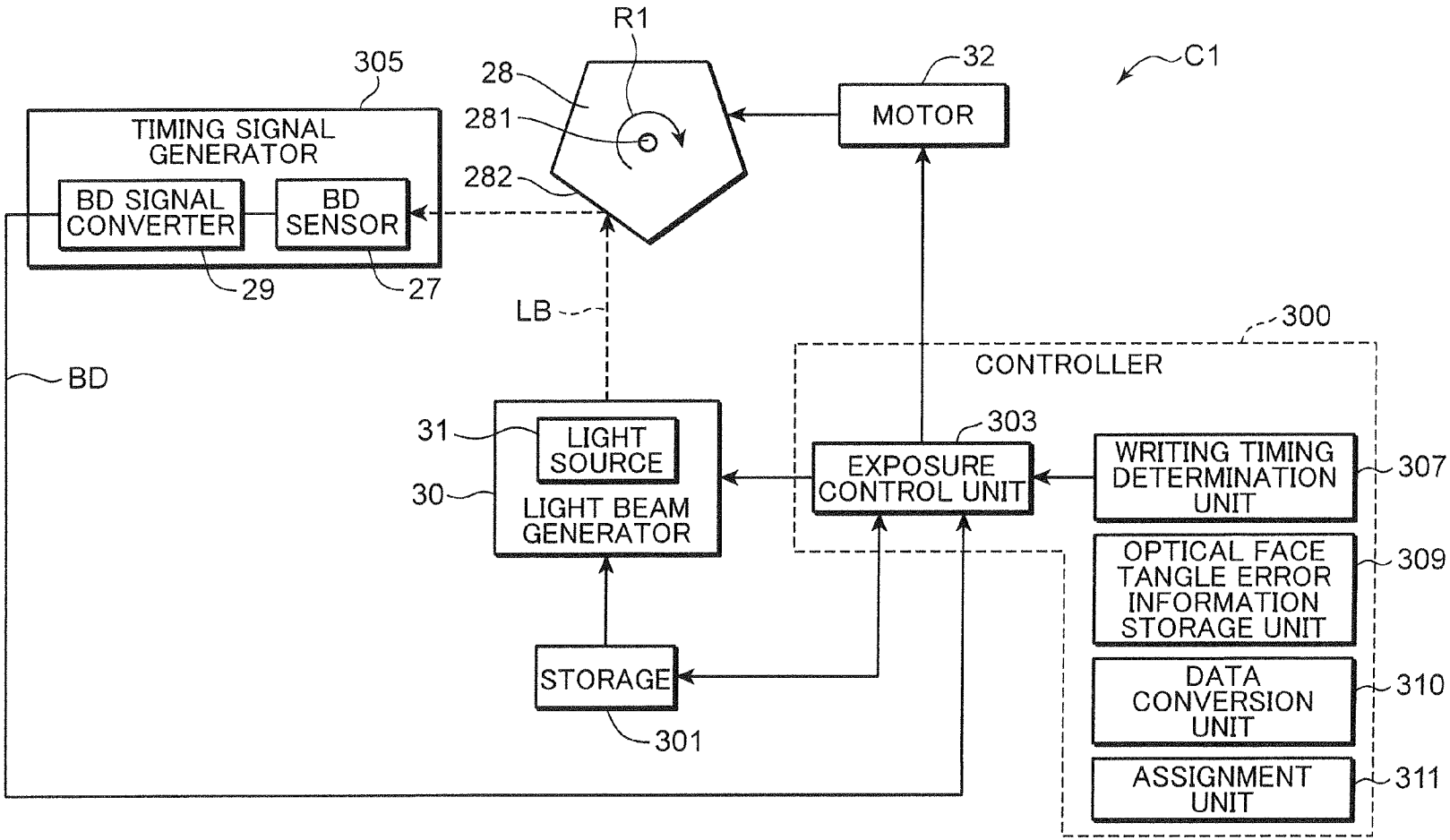
FIG. 3 is a block diagram showing a light beam irradiation control system according to a first embodiment of the present disclosure.

FIG. 2 is a diagram showing a state where a light beam LB is irradiated to a reflecting surface 282 of the polygon mirror 28 in the exposure device 6. FIG. 3 is a block diagram showing a light beam irradiation control system C1 according to the first embodiment. Note that optical components such as a collimator lens and an fθ lens are not shown in FIG. 2.

The irradiation control system C1 according to the first embodiment includes a light beam generator 30, a controller 300, a storage 301 and a timing signal generator 305. The exposure device 6 includes a BD (Beam Detect) sensor 27, the motor 32 and a light source 31 in the housing thereof in addition to the above polygon mirror 28.

The light beam generator 30 includes the light source 31 for emitting a light beam LB and a drive circuit for driving the light source 31. A semiconductor laser for outputting laser light is, for example, used as the light source 31. The storage 301 stores image data which is transmitted from an external apparatus and based on which an electrostatic latent image is to be formed.

The polygon mirror 28 reflects a light beam LB generated by the light beam generator 30. The polygon mirror 28 rotates in a direction of an arrow R1 about a rotary shaft 281 by driving the motor 32. The polygon mirror 28 has, for example, a right pentagonal peripheral side surface and five side surfaces correspond to the reflecting surfaces 282.

The controller 300 governs the control of the entire image forming apparatus 1 and is configured by a microcomputer including a CPU (Central Processing Unit), a ROM (Read Only Memory) storing various programs, data necessary to execute these programs and the like in advance, a RAM (Random Access Memory) which serves as a working memory and its peripheral circuits. The controller 300 functionally includes an exposure control unit 303, a writing timing determination unit 307 (determination unit), an optical face tangle error information storage unit 309 (storage unit), a data conversion unit 310 and an assignment unit 311 by executing a predetermined program.

The optical face tangle error information storage unit 309 stores optical face tangle error information of the five reflecting surfaces 282 of the polygon mirror 28. The writing timing determination unit 307 determines the writing timing of each line of dot image data to be described later based on the optical face tangle error information of each reflecting surface 282 of the polygon mirror 28 stored in the optical face tangle error information storage unit 309. A method for determining this writing timing is described in detail later.

The data conversion unit 310 converts image data input to the image forming apparatus 1 into dot image data in which pixel values having gradation information are arranged in a matrix. The assignment unit 311 performs a process of assigning a number to each reflecting surface 282, specifying by which of a plurality of reflecting surfaces 282 a light beam LB emitted from the light source 31 is to be reflected for each line of the dot image data and assigning the number of the reflecting surface to each line of the dot image data.

The exposure control unit 303 performs a control of causing the light beam generator 30 to irradiate a light beam LB to image an electrostatic latent image on the circumferential surface of the photoconductive drum 4. That is, the exposure control unit 303 sends image data stored in the storage 301 to the light beam generator 30 and causes the light beam generator 30 to emit a light beam LB in accordance with a writing timing determined by the writing timing determination unit 307 while rotating the polygon mirror 28 by the motor 32. The light beam LB emitted from the light source 31 is irradiated to the rotating polygon mirror 28 and deflected by the reflecting surface 282, whereby a scan line SL is imaged in a main scanning direction D1 on the circumferential surface of the photoconductive drum 4 (see FIG. 2). One scan line SL is imaged by one reflecting surface 282. By repeatedly imaging one scan line SL on the rotating photoconductive drum 4 in this way, an electrostatic latent image is imaged along a sub scanning direction. The sub scanning direction corresponds to a rotating direction R2 of the photoconductive drum 4.

The timing signal generator 305 includes the BD sensor 27 and a BD signal converter 29. The light beam LB is repeatedly scanned in the main scanning direction D1 in a scanning range set to be longer than a dimension of the photoconductive drum 4 in the main scanning direction D1. The BD sensor 27 is disposed at a position of this scanning range where the light beam LB is received before starting to scan the photoconductive drum 4.

The BD sensor 27 is a photosensor and outputs a light reception signal to the BD signal converter 29 upon receiving the light beam LB reflected by the reflecting surface 282. The BD signal converter 29 shapes that light reception signal into a timing signal BD having a rectangular wave and outputs the timing signal BD to the exposure control unit 303.

The timing signal BD is a signal as a reference in aligning the writing positions in the main scanning direction D1 when an electrostatic latent image is imaged on the photoconductive drum 4. The exposure control unit 303 causes the light beam LB to be emitted in accordance with the writing timing determined by the writing timing determination unit 307 based on the timing signal BD.

Figure 4A:
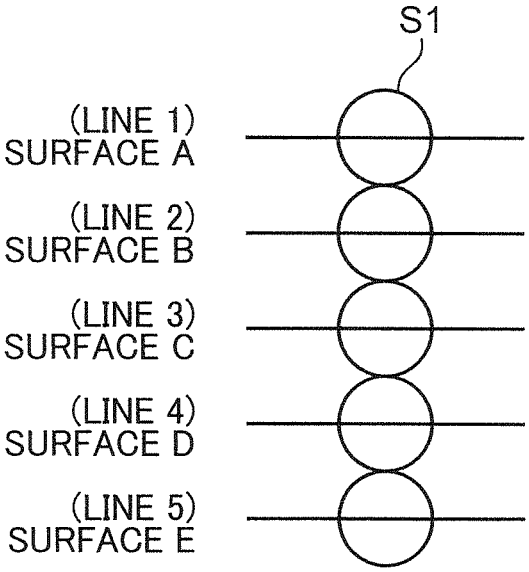
FIG. 4A is a diagram showing light beam irradiation positions when a polygon mirror has no optical face tangle error and FIG. 4B is a diagram showing light beam irradiation positions when a polygon mirror has an optical face tangle error.
Figure 4B:
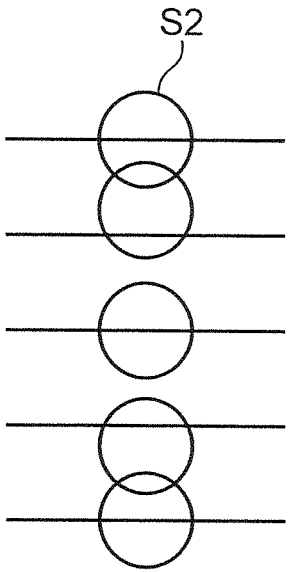

Next, an optical face tangle error of a polygon mirror is described. FIG. 4A is a diagram showing irradiation positions S1 of a light beam LB when a polygon mirror has no optical face tangle error and FIG. 4B is a diagram showing irradiation positions S2 of a light beam LB when a polygon mirror has an optical face tangle error. Circles shown as the irradiation positions S1, S2 in FIGS. 4A and 4B indicate spots formed on the circumferential surface of the photoconductive drum 4 by the light beam LB. Surfaces A, B, C, D and E indicate the five reflecting surfaces 282 of the polygon mirror 28. Each straight line in FIGS. 4A and 4B indicates an ideal irradiation position on each reflecting surface 282 (normal line pitches are shown between the lines). In the case of the polygon mirror having no optical face tangle error, the line pitches formed by the respective reflecting surfaces 282 are constant as shown in FIG. 4A. That is, the centers of the spots formed by the light beam LB reflected by the surfaces A to E are all located on the straight lines indicating the ideal irradiation positions.

On the other hand, in the case of the polygon mirror having an optical face tangle error, the irradiation position S2 of the light beam deviates from the ideal irradiation position depending on the reflecting surface as shown in FIG. 4B.

According to an example of FIG. 4B, the optical face tangle error is absent on the surfaces A, C and E, but the irradiation positions S2 deviate from the ideal positions on the surfaces B, D and, hence, the optical face tangle error is known to be present. Due to the presence of such an optical face tangle error, pitches between the lines formed on the photoconductive drum 4 vary. For example, a scan line generated by scanning the spot formed by the light beam LB reflected by the surface B is too close to the one generated by the surface A. If there is a line pitch variation, an image with good quality cannot be obtained. Further, if vibration is generated due to high-speed rotation of the polygon mirror 28, a similar phenomenon is known to occur.

Figure 5:
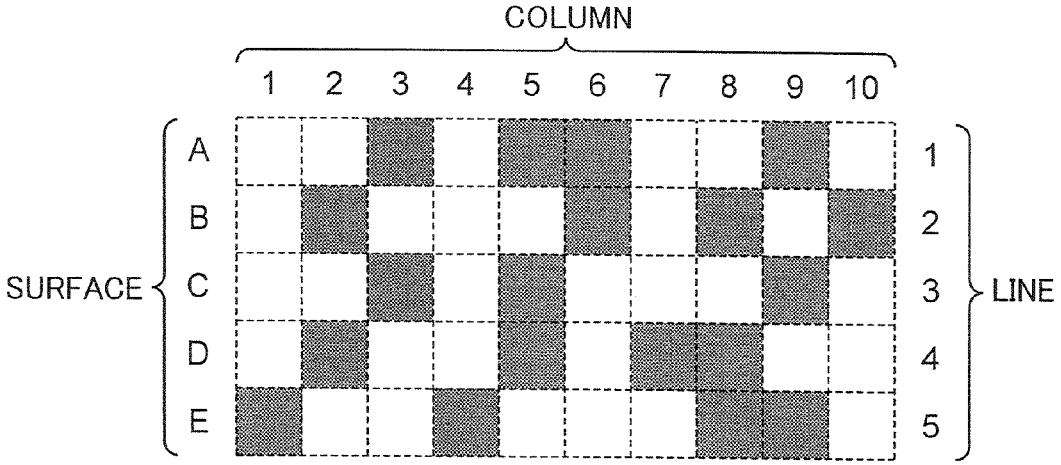
FIG. 5 is a diagram showing an example of a dot image when the polygon mirror has no optical face tangle error.
Figure 6:
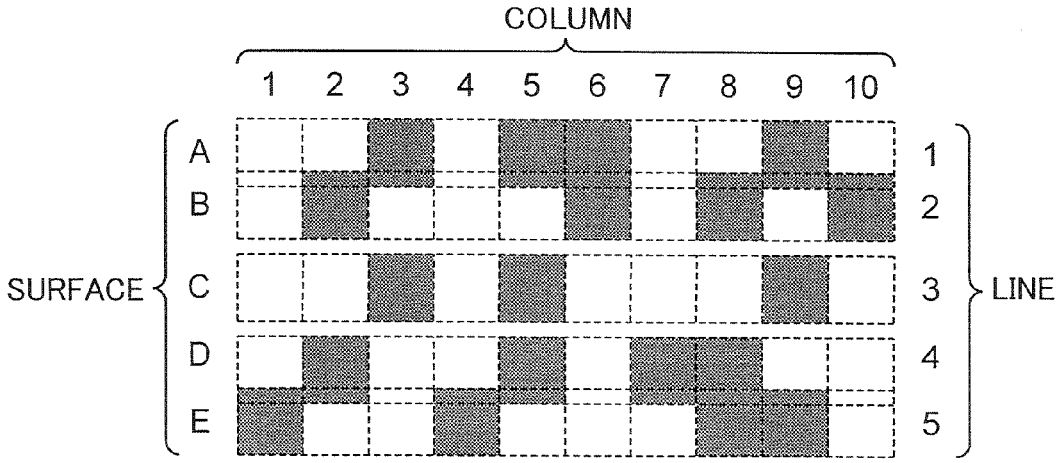
FIG. 6 is a diagram showing an example of a dot image when the polygon mirror has an optical face tangle error.

FIGS. 5 and 6 are diagrams showing examples of a dot image. FIG. 5 shows a dot image formed by an ideal polygon mirror having no optical face tangle error, and FIG. 6 shows a dot image formed using a polygon mirror having an optical face tangle error. Note that dotted lines in FIGS. 5 and 6 are lines not supposed to be formed as images, but are drawn to facilitate the understanding that respective dots are formed in correspondence with pixel data arranged in a matrix. Here are shown 50 pixel data composed of 10 columns×5 lines. The assignment unit 311 assigns line numbers 1 to 5 to the respective reflecting surfaces, i.e. surfaces A to E and assigns one of these line numbers to each line of the pixel data.

As described above, image data input from the external apparatus or the like is converted into dot image data configured such that pixel values having gradation information are arranged in a matrix by the data conversion unit 310 of the controller 300. Dots shown in gray in FIGS. 5 and 6 indicate pixels with dark gradation, whereas empty dots indicate white pixels. The exposure control unit 303 causes the light beam generator 30 to generate a light beam LB modulated based on the pixel values (gradation information) of the respective pixels configuring the dot image data.

In the case of using an ideal polygon mirror, dots are formed at regular line pitches as shown in FIG. 5 without adjacent dots overlapping each other or being separated from each other.

On the other hand, in the case of using a polygon mirror having an optical face tangle error, the line pitches are brought into disarray, wherefore adjacent dots overlap each other and are separated from each other. For example, if the optical face tangle error is present on the surfaces B, D of the polygon mirror 28, the dots of the lines given to line numbers 2, 4 are formed while being shifted as shown in FIG. 6.

Specifically, adjacent ones of dots formed by the light beam LB reflected by the surface A that is one of the reflecting surfaces 282 (the line numbered by 1=line 1) and those formed by the light beam LB reflected by the surface B (line 2) overlap each other. A dot position in the main scanning direction is indicated by a column number, a dot number in the sub scanning direction is indicated by a line number, and a dot having the line number X and the column number Y is written as a "dot (X-Y)". Based on this definition, adjacent ends of the dots 1-6, 2-6 are in an overlapping state.

Dots in a diagonal relationship (e.g. dots 1-3, 2-2) are supposed to be formed at positions where corners are facing each other, but sides thereof are partly in contact. Further, the dots formed by the light beam LB reflected by the surface B (line 2) and those formed by the light beam LB reflected by the surface C (line 3) are spaced apart.

Similarly, the dots formed by the light beam LB reflected by the surface C (line 3) and those formed by the light beam LB reflected by the surface D (line 4) are spaced apart. Further, the dots formed by the light beam LB reflected by the surface D (line 4) and those formed by the light beam LB reflected by the surface E (line 5) are too close to each other and the adjacent dots 4-8, 5-8 are overlapping. Further, sides of the dots in a diagonal relationship (e.g. dots 4-5, 5-4) are partly in contact. If the sides of the dots in a diagonal relationship are in contact and spaced apart in this way, contact parts look dark in color and spaced-apart parts look light in color, wherefore an image with good quality cannot be obtained.

Accordingly, the writing timing determination unit 307 determines the writing timing of each line based on the optical face tangle error information of each reflecting surface 282. This can suppress image quality deterioration that occurs due to a line pitch variation caused by the optical face tangle error. This method for determining the writing timing is described in detail below.

The optical face tangle error of each reflecting surface 282 of the polygon motor 28 is measured in advance before shipment from a factory of the image forming apparatus 1. Deviation amounts and deviation directions in the sub scanning direction of lines formed by light reflected by the respective reflecting surfaces 282 are stored in advance in the optical face tangle error information storage unit 309 in correspondence with the respective reflecting surfaces 282. The assignment unit 311 calculates by which reflecting surface 282 the light beam LB emitted for each line of the dot image data is to be reflected and assigns the reflecting surface number to each line. The writing timing determination unit 307 determines the writing timing of each line based on the reflecting surface number assigned to each line and the optical face tangle error information of each reflecting surface 282 stored in the optical face tangle error information storage unit 309.

The writing timing determination unit 307 successively sets a target pixel for non-white pixels out of the pixels of the line of the dot image data to which a certain reflecting surface number is assigned, and determines the writing timing of this line based on the pixel value on the target pixel and the pixel values on the line one above the line on which this target pixel is located.

Specifically, if the pixel right above and the pixel at the upper right side are white and the pixel at the upper left side is not white when viewed from the target pixel in data indicated by the line one above the line including the target pixel, the writing timing determination unit 307 increments a first count number when a pitch between this line and the line one above this line is wider than a reference pitch and increments a second count number different from the first count number when this pitch is narrower than the reference pitch. That "the pixel right above and the pixel at the upper right side are white and the pixel at the upper left side is not white when viewed from the target pixel" means that, out of three pixels above the target pixel, only the pixel at the upper left side is not white (black or the like). When the line pitch is wider than the reference pitch (the lines are spaced apart), the spacing between the lines can be visually reduced by bringing the target pixel and the pixel on the upper left side toward each other. Further, when the line pitch is narrower than the reference pitch (the lines are overlapping), a degree of overlapping between the lines can be visually reduced by bringing the target pixel and the pixel at the upper left side away from each other.

The writing timing determination unit 307 performs a similar counting process also when the pixel right above and the pixel at the upper left side are white and the pixel at the upper right side is not white when viewed from the target pixel. In this case, the writing timing determination unit 307 increments the second count number when the pitch between this line and the line one above this line is wider than the reference pitch and increments the first count number when the pitch is narrower than the reference pitch.

The writing timing determination unit 307 determines to advance the writing timing of this line by a predetermined time from a normal writing timing when the first counter number is larger than the second count number and delay the writing timing of this line by a predetermined time from the normal writing timing when the second count number is larger than the first count number. Here, the first count number indicates a number capable of achieving a visual effect for the above two pixels by advancing the writing timing of the line and the second count number indicates a number capable of achieving a visual effect for the above two pixels by delaying the writing timing of the line. The above process of the writing timing determination unit 307 is described below by way of specific examples.

Figure 7:
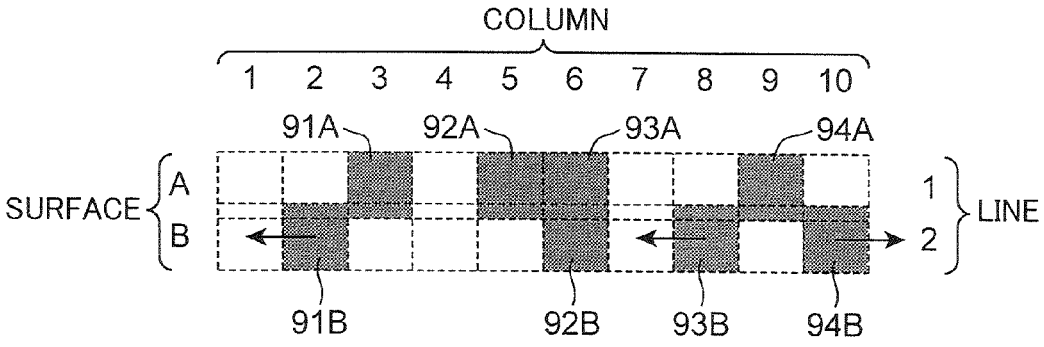
FIG. 7 is a diagram showing extracted lines 1 and 2 out of the dot image shown in FIG. 6.

FIG. 7 is a diagram showing extracted lines 1, 2 out of the dot image data shown in FIG. 6, i.e. showing a case where there is an overlapping between the lines (narrower than the reference pitch). Note that the dot image data used in determining the writing timing by the writing timing determination unit 307 is data free from an overlapping between the line as shown in FIG. 7 and the pixel values are arranged in a matrix. However, to facilitate visual understanding, the dot image data used in the process by the writing timing determination unit 307 is also shown and described with a line pitch deviation below.

First, a target pixel is determined for the line 2. Note that the target pixel is a pixel having a pixel value other than white. If the target pixel is a dot 91B (dot 2-2), pixel values of neighboring pixels of the dot 91B on the line having the line number 1 one above the line 2 are checked. The neighboring pixels of the dot 91B on the line 1 are pixels 1-1, 1-2 and 1-3 and the pixel 1-3 (dot 91A) has a pixel value other than white.

When the optical face tangle error is not present on the polygon motor 28, corners of the dots 91A, 91B face each other. However, if the optical face tangle error is present, the line pitch is in disarray and sides of the two dots are partly in contact. Accordingly, the writing timing is shifted in a direction to solve this contact relationship. That is, the contact of the dots 91B, 91A can be eliminated by moving the dot 91B in a direction of an arrow shown on the dot 91B (by advancing the writing timing). Thus, the writing timing determination unit 307 increments the count (advance count; first count number) in a direction to advance the writing timing.

Next, when the target pixel is a dot 92B (dot 2-6), non-white pixels out of neighboring pixels of the dot 92B on the line 1 are a dot 92A (dot 1-5) and a dot 93A (dot 1-6). The writing timing determination unit 307 moves the target pixel only when, out of the neighboring pixels of the target pixel, the pixel right above is white and either one of the pixels in a diagonal relationship is not white. Accordingly, for the dot 92B, the writing timing determination unit 307 does not increment the count in a direction to advance the writing timing (advance count) or the count in a direction to delay the writing timing (delay count; second count number).

Next, when the target pixel is a dot 93B (dot 2-8), a non-white pixel out of neighboring pixels of the dot 93B on the line 1 is a dot 94A (dot 1-9). Accordingly, the dot 93B is moved in a direction of an arrow shown on the dot 93B. That is, since the dot 93B can be moved in the direction of the arrow shown on the dot 93B by advancing the writing timing, the writing timing determination unit 307 increments the count (advance count) in the direction to advance the writing timing.

When the target pixel is a dot 94B (dot 2-10), a non-white pixel out of neighboring pixels of the dot 94B on the line 1 is the dot 94A (dot 1-9). Accordingly, the dot 94B is moved in a direction of an arrow shown on the dot 94B. That is, since the dot 94B can be moved in the direction of the arrow shown on the dot 94B by delaying the writing timing, the writing timing determination unit 307 increments the count (delay count) in the direction to delay the writing timing.

In this way, the writing timing determination unit 307 successively determines the non-white pixels on the line 2 as a target pixel and increments the count (advance count; first count number) in the direction to advance the writing timing when only the pixel at the upper right side is not white out of the neighboring pixels of the target pixels on the line one above and increments the count (delay count; second count number) in the direction to delay the writing timing when only the pixel at the upper left side is not white. The writing timing determination unit 307 finally compares the advance count and the delay count, advances the writing timing if "advance count>delay count", delays the writing timing if "advance count<delay count" and does not change the writing timing (preset normal writing timing is used) if "advance count=delay count". Since the advance count=2 and the delay count=1 in the case of FIG. 7, the writing timing determination unit 307 sets the writing timing of the line 2 to be earlier by a predetermined time. A variation width of the writing timing is a predetermined time, e.g. ¼ pixel.

Next, a case where the lines are spaced apart (line pitch is wider than the reference pitch) is described. In FIG. 6, since the dots on the line 2 are displaced toward the line 1, there is a clearance between the dots on the lines 2 and 3. Specifically, corner vertices of dots 2-2 and 3-3, dots 2-6 and 3-5, dots 3-9 and 2-8, 2-10 are supported to be in contact, but these dots are spaced apart from each other. Accordingly, on the line 3, the writing timing is changed in a direction to reduce distances (center-to-center distances) connecting the centers of the dots in a diagonal relationship. By reducing the center-to-center distances of the dots in the diagonal relationship, an optical illusion in which the dots look to be connected can be induced even if the dots are actually spaced apart.

Figure 8:
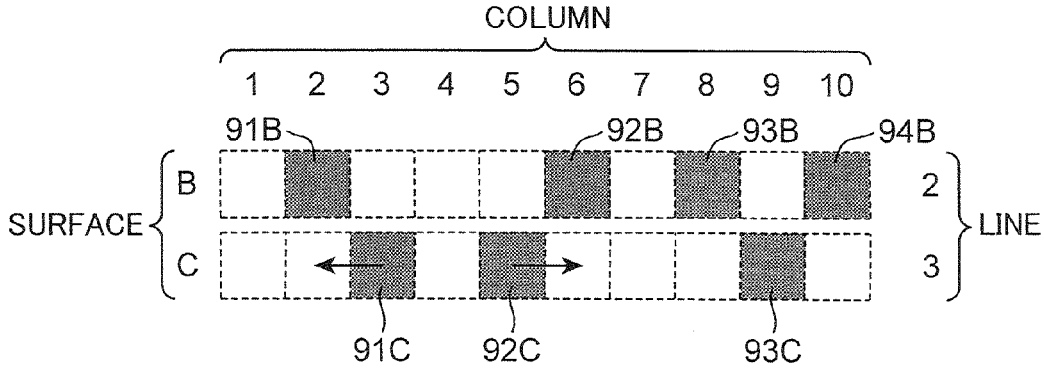
FIG. 8 is a diagram showing extracted lines 2 and 3 out of the dot image shown in FIG. 6, FIGS. 9 and 10 are a flow chart showing the flow of an exposure process in the first embodiment.

Here, a method for determining the writing timing of the line 3 by the writing timing determination unit 307 is described. FIG. 8 is a diagram showing extracted lines 2 and 3 out of the dot image data shown in FIG. 6. First, when the target pixel is a dot 91C (dot 3-3), a non-white pixel out of neighboring pixels of the dot 91C on the line 2 is a dot 91B (dot 2-2). Accordingly, the dot 91C is moved in a direction of an arrow shown on the dot 91C. That is, a center-to-center distance of the two dots can be reduced by moving the dot 91C in the direction of the arrow shown on the dot 91C by advancing the writing timing. Thus, the writing timing determination unit 307 increments the advance count.

Next, when the target pixel is a dot 92C (dot 3-5), a non-white pixel out of neighboring pixels of the dot 92C on the line 2 is a dot 92B (dot 2-6) at the upper right side. Accordingly, the writing timing determination unit 307 judges to move the dot 92C in a direction of an arrow shown on the dot 92C. That is, since the dot 92C can be moved in the direction of the arrow shown on the dot 92C by delaying the writing timing, the writing timing determination unit 307 increments the delay count.

When the target pixel is a dot 93C (dot 3-9), non-white pixels out of neighboring pixels of the dot 93C on the line 2 are a dot 93B (dot 2-8) and a dot 94B (dot 2-10). Thus, the writing timing determination unit 307 increments neither the advance count nor the delay count.

As just described, since the advance count=1 and the delay count=1 and the both are equal in the example of FIG. 8, the writing timing determination unit 307 sets a preset normal writing timing without changing the writing timing of the line 3.

As described above, the writing timing determination unit 307 changes the writing timing by comparing the pixel values between the lines (positional relationship of the white pixels and the non-white pixels) if the line pitch is not normal. Thus, the writing timing can be adjusted in consideration of a positional relationship of the dots between the lines and image quality deterioration caused by the optical face tangle error can be reduced.

By successively setting the non-white pixels out of the pixels of one line as the target pixel and finally comparing the advance count and the delay count to determine which is larger, the writing timing determination unit 307 judges whether it is better to advance or delay the writing timing of the line. By the writing timing determination unit 307 adjusting the writing timing in this way, image quality deterioration caused by the optical face tangle error can be suppressed.

Figure 9:
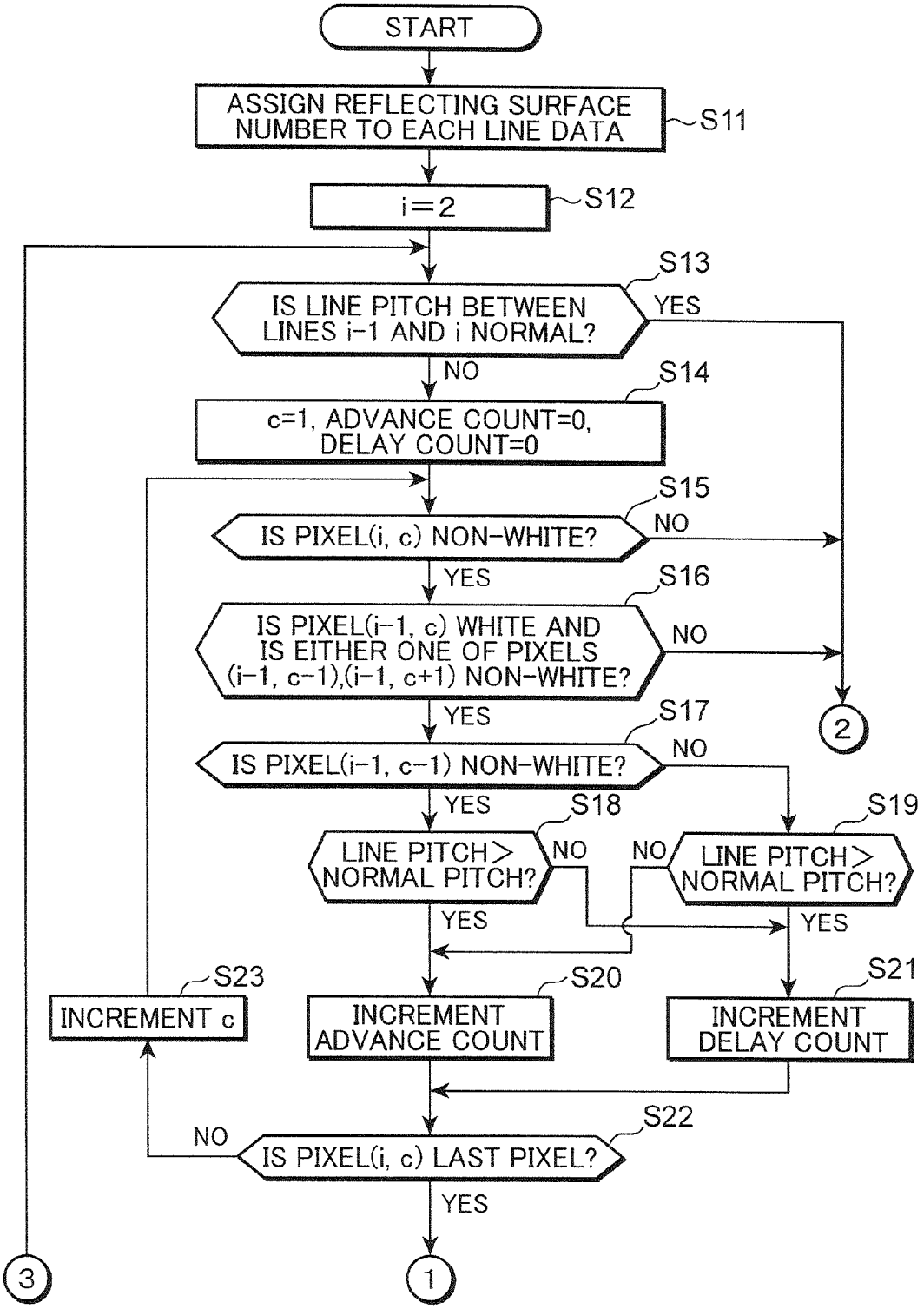
Figure 10:
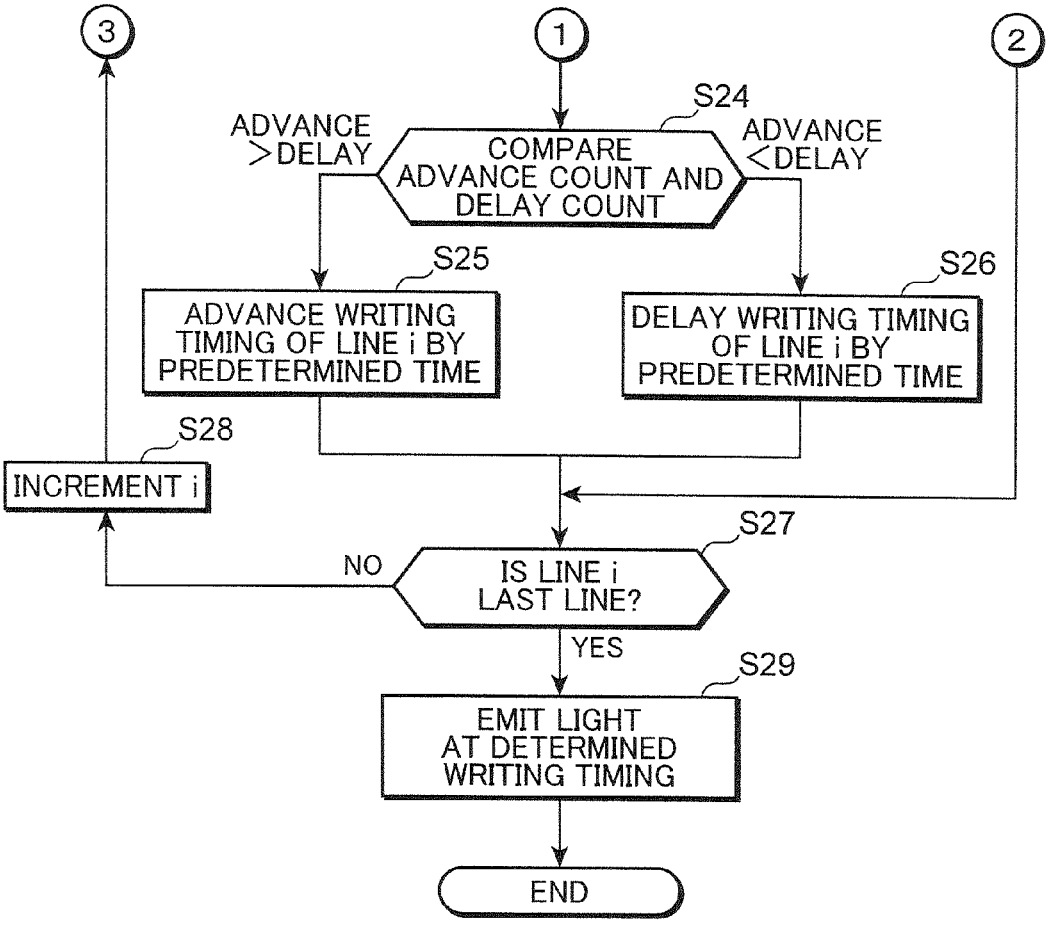

FIGS. 9 and 10 are a flow chart showing the flow of the exposure control in the first embodiment. First, the assignment unit 311 calculates by which reflecting surface 282 the light beam LB of each line of the dot image data is to be reflected and assigns the reflecting surface number to each line (Step S11). To cause the polygon motor 28 to perform image formation from a home position, the exposure control unit 303 controls the motor 32 before image formation. The home position means a state where the reflecting surface to which the light beam LB of the line 1 is irradiated is set in advance and this reflecting surface is at a position facing the light source 31. Since the reflecting surface to which the light beam LB of the line 1 is irradiated is determined in advance, the assignment unit 311 only has to successively assign the reflecting surface numbers to the respective lines.

Subsequently, the writing timing determination unit 307 substitutes 2 for a variable i (i is an integer not smaller than 2) (Step S12) and judges whether or not a line pitch in the sub scanning direction between lines i−1 and i is a normal line pitch, using the optical face tangle error information stored in the optical face tangle error information storage unit 309 (Step S13). Whether or not the line pitch is normal is judged by the writing timing determination unit 307 reading the optical face tangle error information from the optical face tangle error information storage unit 309 based on the reflecting surface numbers assigned to the lines i−1, i and calculating the pitch between the two lines.

If the line pitch between the lines i−1 and i is not normal (Step S13; NO), the writing timing determination unit 307 substitutes 1 for a variable c (c is an integer not smaller than 1) and substitute 0 for the advance count and the delay count (both are variable names and integers not smaller than 0) (Step S14).

Subsequently, the writing timing determination unit 307 judges whether or not a pixel (i, c) is a non-white pixel (Step S15). If this pixel is a non-white pixel (Step S15; YES), the writing timing determination unit 307 performs the following process, setting the pixel (i, c) as a target pixel.

Subsequently, the writing timing determination unit 307 judges whether or not a pixel (i−1, c) is white and either one of pixels (i−1, c−1), (i−1, c+1) is not white (Step S16). In this Step, it is questioned whether a pixel above the target pixel is white and either one of pixels at the upper right side and the upper left side is non-white.

The writing timing determination unit 307 increments the advance count (Step S20) if the pixel (i−1, c) is white and only either one of the pixels (i−1, c−1), (i−1, c+1) is non-white (the pixel above the target pixel is white and either one of the pixels at the upper right side and the upper left side is non-white) (Step S16; YES), the pixel (i−1, c−1) is non-white (the pixel at the upper left side of the target pixel is non-white) (Step S17; YES) and the line pitch between the lines i−1, i is wider than the normal line pitch (Step S18; YES). On the other hand, the writing timing determination unit 307 increments the delay count (Step S21) if the line pitch between the lines i−1, i is narrower than the normal line pitch (Step S18; NO).

Further, the writing timing determination unit 307 increments the delay count (Step S21) if the pixel (i−1, c−1) is white and the pixel (i−1, c+1) is non-white (i.e. the pixel at the upper right side of the target pixel is non-white) (Step S17; NO) and the line pitch between the lines i−1, i is wider than the normal line pitch (Step S19; YES). On the other hand, the writing timing determination unit 307 increments the advance count (Step S20) if the line pitch between the lines i−1, i is narrower than the normal line pitch (Step S19; NO).

If the pixel (i, c) is not the last pixel of the line (Step S22; NO), the writing timing determination unit 307 returns to Step S15 after incrementing the variable c (Step S23).

If the pixel (i, c) is the last pixel of the line (Step S22; YES), the writing timing determination unit 307 compares the advance count and the delay count (Step S24). If advance count>delay count, the writing timing determination unit 307 advances the writing timing of the line i by the predetermined time (Step S25). On the other hand, if advance count<delay count, the writing timing determination unit 307 delays the writing timing of the line i by the predetermined time (Step S26).

If the line i is not the last line of the image data (Step S27; NO), the writing timing determination unit 307 returns to Step S13 after incrementing the variable i (Step S28).

If the line i is the last line of the image data (Step S27; YES), the exposure control unit 303 causes the light beam generator 30 to generate and irradiate a light beam based on the writing timing of each line determined by the writing timing determination unit 307 (Step S29). The emitted light beam LB is reflected by the respective reflecting surfaces 282 of the polygon motor 28 to irradiate the photoconductive drum 4, whereby an electrostatic latent image is formed on the circumferential surface of the photoconductive drum 4.

Further, if the line pitch between the lines i−1 and i is normal (Step S13; YES), the pixel (i, c) is white (Step S15; NO), the pixel (i−1, c) is white and the both pixels (i−1, c−1) and (i−1, c+1) are non-white (Step S16; NO), the writing timing determination unit 307 proceeds to Step S27.

Note that, in the method for determining the writing timing by the writing timing determination unit 307 described above, judgment is made using the pixels (pixels (i−1, c−1), (i−1, c+1)) on the line one above the line where the target pixel (pixel (i, c)) is located in judging which of the advance count and the delay count is to be incremented. Besides this, pixels (i.e. the pixel (i+1, c−1) and (i+1, c+1)) on the line one below the line where the target pixel is located may be considered in determining the writing timing.

Further, if the writing timing determination unit 307 determines to advance the writing timing of the line i by the predetermined time (e.g. time t), the writing timing of the line i may be directly advanced by the time t, but the writing timing of the line i may be advanced by a time t/2 and the writing timing of the line i−1 may be delayed by the time t/2. Conversely, if the writing timing determination unit 307 determines to delay the writing timing of the line i by the time t, the writing timing of the line i may be delayed by the time t/2 and the writing timing of the line i−1 may be advanced by the time t/2. The writing timings of the lines i, i−1 are relatively shifted by the time t also by such writing timing adjustments. In this case, since a change amount of the writing timings can be reduced as compared with the case where only the writing timing of one line is changed, there is an advantage of being able to reduce deviation amounts from the neighboring lines caused by changing the writing timings.

As described above, in the first embodiment, the assignment unit 311 assigns the number to each of the plurality of reflecting surfaces 282, specifies by which of the plurality of reflecting surfaces 282 light emitted for each line of the dot image data is to be reflected and assigns the reflecting surface number to each line of the dot image data. The writing timing determination unit 307 determines the writing timing of each line based on the number of the reflecting surface 282 assigned to each line, the optical face tangle error information of each reflecting surface 282 stored in the optical face tangle error information storage unit 309 and the pixel values. That is, if the line pitches of an image to be formed are not normal due to the optical face tangle error of the polygon mirror 28, the writing timing determination unit 307 refers the pixel values between the lines and changes the writing timing. Thus, the writing timing can be adjusted in consideration of the positional relationship of dots between the lines. Therefore, image quality deterioration caused by the optical face tangle error of the polygon mirror 28 can be suppressed.

Note that, in the above first embodiment, the writing timing determination unit 307 is described to determine the writing timing of each line when the respective reflecting surfaces 282 of the polygon mirror 28 have an optical face tangle error. Besides this optical face tangle error, the rotary shaft 281 may be tilted by vibration during high-speed rotation of the polygon mirror 28 and a phenomenon similar to the optical face tangle error may occur. Accordingly, vibration during high-speed rotation of the polygon mirror 28 is measured before shipment from the factory of the image forming apparatus 1 and deviation amounts and deviation directions in the sub scanning direction of lines formed by light reflected by the respective reflecting surfaces 282 are measured and stored in the optical face tangle error information storage unit 309 in the occurrence of the optical face tangle error caused by vibration. In performing image formation by rotating the polygon mirror 28 at a high speed, the writing timing determination unit 307 reads the optical face tangle error information from the optical face tangle error information storage unit 309 and performs the exposure process shown in FIGS. 10 and 11. This can suppress image quality deterioration even if vibration is generated during high-speed rotation of the polygon mirror 28.

Second Embodiment

In the above first embodiment, an example of adjusting the writing timing of each line of the dot image data is illustrated as a method for setting a light emission mode corresponding to the dot image data. In this second embodiment is described an example of determining the size of dots formed on the circumferential surface of the photoconductive drum 4 by light emitted from the light source 31 for each line of the dot image data.

Figure 11:
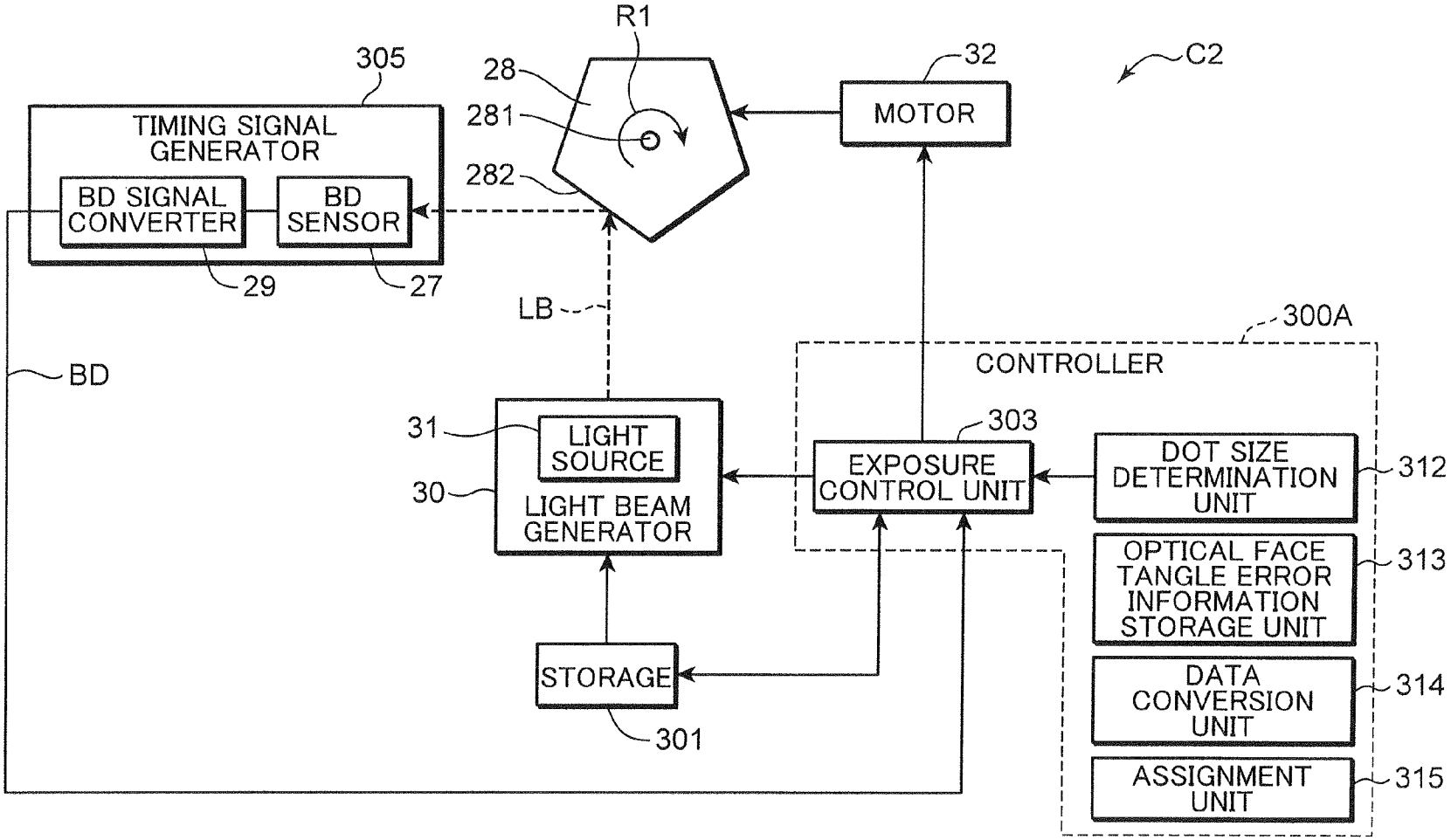
FIG. 11 is a block diagram showing a light beam irradiation control system according to a second embodiment of the present disclosure.

FIG. 11 is a block diagram showing a light beam irradiation control system C2 according to the second embodiment. The irradiation control system C2 according to the second embodiment includes a light beam generator 30, a controller 300A, a storage 301 and a timing signal generator 305. An exposure device 6 includes a polygon mirror 28, a BD sensor 27, a motor 32 and a light source 31 in a housing thereof. These are arranged as shown in FIG. 2. In FIG. 11, the same components as in the first embodiment are denoted by the same reference signs. These same components are not described or only briefly described.

The controller 300A functionally includes an exposure control unit 303, a dot size determination unit 312 (determination unit), an optical face tangle error information storage unit 313 (storage unit), a data conversion unit 314 and an assignment unit 315 by executing a predetermined program.

The exposure control unit 303 performs a control of causing the light beam generator 30 to irradiate a light beam LB to image an electrostatic latent image on the circumferential surface of the photoconductive drum 4. The optical face tangle error information storage unit 313 stores optical face tangle error information of the five reflecting surfaces 282 of the polygon mirror 28. The data conversion unit 314 converts image data input to the image forming apparatus 1 into dot image data in which pixel values having gradation information are arranged in a matrix. The assignment unit 315 performs a process of assigning a number to each reflecting surface 282, specifying by which of the plurality of reflecting surfaces 282 a light beam LB emitted from the light source 31 is to be reflected for each line of the dot image data and assigning the number of the reflecting surface to each line of the dot image data.

The dot size determination unit 312 determines the size of dots for each line of the dot image data based on the optical face tangle error information of each reflecting surface 282 of the polygon mirror 28 stored in the optical face tangle error information storage unit 313.

The exposure control unit 303 performs a control of causing the light beam generator 30 to irradiate a light beam LB to image an electrostatic latent image on the circumferential surface of the photoconductive drum 4 in accordance with the dot size determined by the dot size determination unit 312. That is, the exposure control unit 303 sends image data stored in the storage 301 to the light beam generator 30 and causes the light beam generator 30 to emit a light beam LB in accordance with the dot size determined by the dot size determination unit 312 while rotating the polygon mirror 28 by the motor 32. As shown in FIG. 11, the light beam LB emitted from the light source 31 is irradiated to the rotating polygon mirror 28 and deflected by the reflecting surface 282, whereby a scan line SL is imaged in a main scanning direction D1 on the photoconductive drum 4. One scan line SL is imaged by one reflecting surface 282. This point is the same as in the first embodiment.

The optical face tangle error of each reflecting surface 282 of the polygon motor 28 is measured in advance before shipment from the factory of the image forming apparatus 1. Deviation amounts and deviation directions in the sub scanning direction of lines formed by light reflected by the respective reflecting surfaces 282 are stored in advance in the optical face tangle error information storage unit 313 in correspondence with the respective reflecting surfaces 282. The assignment unit 315 calculates by which reflecting surface 282 the light beam LB emitted for each line of the dot image data is to be reflected and assigns the reflecting surface number to each line.

The dot size determination unit 312 determines the dot size of each line based on the reflecting surface number assigned to each line and the optical face tangle error information of each reflecting surface 282 stored in the optical face tangle error information storage unit 313. Specifically, the dot size determination unit 312 specifies one reflecting surface and the reflecting surface one before, a pitch between spots of light reflected by which on the circumferential surface of the photoconductive drum 4 is wider or narrower than a predetermined reference pitch from the optical face tangle error information. Then, the dot size determination unit 312 makes the size of the dots larger than a normal dot size by a predetermined value for the lines to which the numbers of the reflecting surfaces causing a line pitch wider than the reference pitch are assigned while making the size of the dots smaller than the normal dot size by a predetermined value for the lines to which the numbers of the reflecting surfaces causing a line pitch narrower than the reference pitch are assigned.

If the line pitch is wider than the reference pitch, a clearance is formed between dots which are supposed to be adjacent (connected). Thus, density is lower than correct density. Conversely, if the line pitch is narrower than the reference pitch, dots overlap each other. Thus, density becomes higher. Accordingly, the dot size determination unit 312 makes the dot size larger by the predetermined value to fill up the clearance between the dots for the lines having a line pitch wider than the reference pitch while making the dot size smaller by the predetermined value to reduce overlapping between the dots for the lines having a line pitch narrower than the reference pitch. By doing so, image quality deterioration caused by the optical face tangle error can be reduced.

Figure 12:
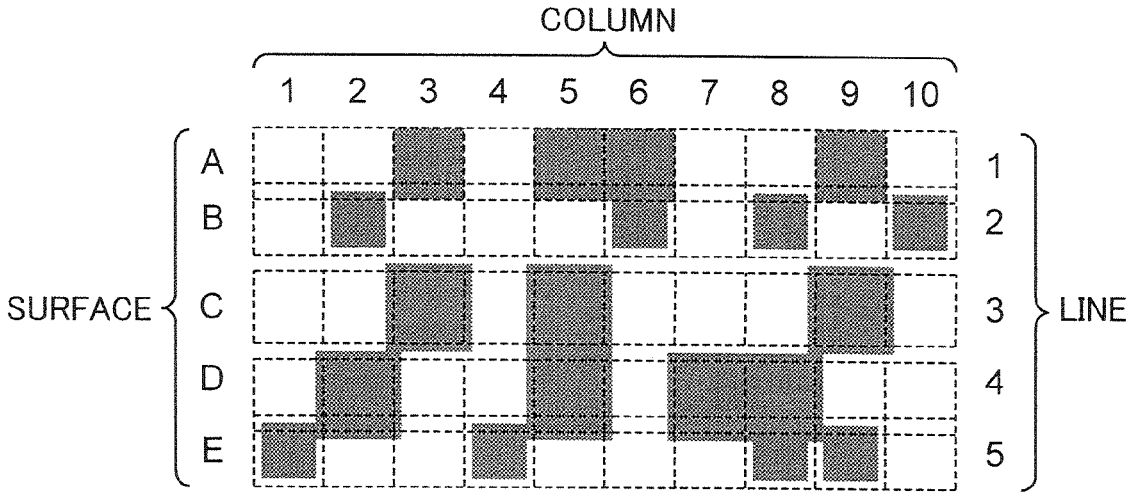
FIG. 12 is a diagram showing an example of a dot image after dot size is changed for each line according to the second embodiment of the present disclosure.
Figure 13:
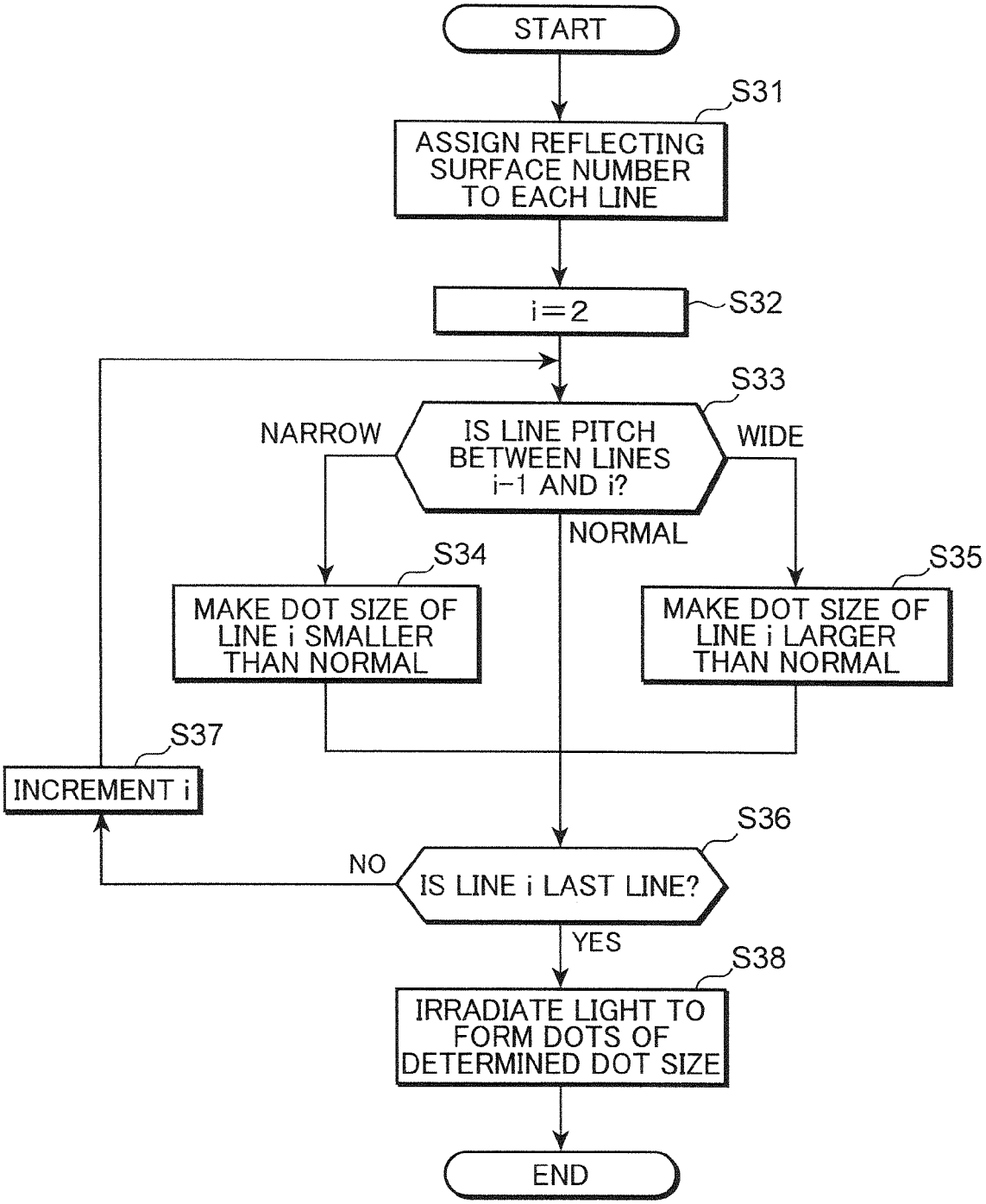
FIG. 13 is a flow chart showing the flow of an exposure process according to the second embodiment.

FIG. 12 is a diagram showing a dot image data after the dot size is changed for each line in the dot image data shown in FIG. 6. FIG. 13 is a flow chart showing the flow of an exposure control by the controller 300A.

First, the assignment unit 315 calculates by which reflecting surface 282 the light beam LB of each line of the dot image data is to be reflected and assigns the reflecting surface number to each line (Step S31). To cause the polygon motor 28 to perform image formation from a home position, the exposure control unit 303 controls the motor 32 before image formation. The home position means a state where the reflecting surface to which the light beam LB of the line 1 is irradiated is set in advance and this reflecting surface is at a position facing the light source 31. Since the reflecting surface to which the light beam LB of the line 1 is irradiated is determined in advance, the assignment unit 315 only has to successively assign the reflecting surface numbers to the respective lines.

Subsequently, the dot size determination unit 312 substitutes 2 for a variable i (i is an integer not smaller than 2) (Step S32) and judges whether or not a line pitch in the sub scanning direction between lines i−1 and i is a normal line pitch, using the optical face tangle error information stored in the optical face tangle error information storage unit 313 (Step S33). Whether or not the line pitch is normal is judged by the dot size determination unit 312 reading the optical face tangle error information from the optical face tangle error information storage unit 313 based on the reflecting surface numbers assigned to the lines i−1, i and calculating the pitch between the two lines.

If the line pitch between the lines i−1 and i is narrower than the normal pitch ("NARROW" in Step S33), the dot size determination unit 312 sets the dot size of the line i to be smaller than the normal dot size by a predetermined value (Step S34) and proceeds to Step S36.

In the example of the dot image data shown in FIG. 6, the line pitch between the lines 1 and 2 is narrower than the normal line pitch. Thus, it can be known that sides of two dots in a diagonal relationship are partly in contact and dots one above the other that are supposed to be in a positional relationship to be adjacent (connected) to each other are overlapping each other. Specifically, dots 1-3, 2-2 are in a positional relationship that sides thereof are partly in contact and dots 1-6, 2-6 overlap each other. To solve this contact relationship or overlapping relationship, the dot size determination unit 312 sets the dot size of the line 2 to be smaller than the normal size by the predetermined value.

On the other hand, if the line pitch between the lines i−1 and i is wider than the normal pitch ("WIDE" in Step S33), the dot size determination unit 312 sets the dot size of the line i to be larger than the normal dot size by a predetermined value (Step S35) and proceeds to Step S36.

In the example of the dot image data shown in FIG. 6, the line pitch between the lines 3 and 4 is wider than the normal line pitch and clearances are formed between adjacent dots. Specifically, these clearances are the one between dots 3-3 and 4-2, the one between dots 3-5 and 4-5 and the like. To reduce these clearances between the dots, the dot size determination unit 312 sets the dot size of the line 4 to be larger than the normal dot size by the predetermined value.

If the line pitch between the lines i−1 and i is the normal line pitch ("NORMAL" in Step S33), the dot size determination unit 312 proceeds to Step S36 without changing the dot size of the line i.

Unless the line i is the last line of the image data (NO in Step S36), the dot size determination unit 312 returns to Step S33 after incrementing the variable i (Step S37).

If the line i is the last line of the image data (YES in Step S36), the exposure control unit 303 receives information on the dot size of each line from the dot size determination unit 312 and determines the pulse width of a drive signal of the light source 31, a drive voltage and the like in accordance with that information. The method for changing the dot size is, for example, a method for adjusting a pulse width per pixel in a drive signal of the light source 31 (PWM control) or a method for adjusting a drive voltage of the light source 31 (PAM control). The exposure control unit 303 controls the light beam generator 30 using the determined pulse width and drive voltage to generate a light beam LB (Step S38). The emitted light beam LB is reflected by the respective reflecting surfaces 282 of the polygon mirror 28 to irradiate the photoconductive drum 4, whereby an electrostatic latent image is formed on the circumferential surface of the photoconductive drum 4.

As shown in FIG. 6, sizes of the dots 1-3, 2-2 are partly in contact before the dot size is adjusted. However, by adjusting the dot size of each line, the contact relationship of the dots 1-3, 2-2 can be solved as shown in FIG. 12 and an overlapping area of the dots 1-6, 2-6 can also be reduced (the overlapping area can be eliminated depending on the dot size).

Further, the dots 3-5, 4-5 are spaced apart before the dot size is adjusted, but the clearance between the dots 3-5 and 4-5 can be reduced (the dots are brought into contact) by the dot size determination unit 312 increasing the dot size of the line 4.

Note that the dot size determination method described above is an example in which the dot size of the line i is determined based on the line pitch between the line i and the line i−1 one above the line i. In a modification, a line pitch between the line i and the line one below (line i+1) may be considered in determining the dot size.

Furthermore, if the dot size determination unit 312 determines to make the dot size of the line i smaller by a predetermined value D, the dot size of the line i may be reduced by D/2 and that of the line i−1 may be reduced by D/2. Conversely, if the dot size determination unit 312 determines to make the dot size of the line i larger by the predetermined value D, the dot size of the line i may be increased by D/2 and that of the line i−1 may be increased by D/2. That is, in this modification, the dot size determination unit 312 changes the dot sizes of both of the two lines having a line pitch which is not normal. By doing so, change amounts of the dot sizes can be reduced as compared with the case where the dot size of only one line is changed. Thus, an influence on dots on neighboring other lines caused by changing the dot size can be reduced.

As described above, in the second embodiment, the assignment unit 315 assigns the number to each of the plurality of reflecting surfaces 282, specifies by which of the plurality of reflecting surfaces 282 light emitted for each line of the dot image data is to be reflected and assigns the reflecting surface number to each line of the dot image data. The dot size determination unit 312 determines the dot size of each line based on the number of the reflecting surface 282 assigned to each line and the optical face tangle error information of each reflecting surface 282 stored in the optical face tangle error information storage unit 313. By doing so, the dot size can be changed according to the line pitch and image quality deterioration caused by the optical face tangle error of the polygon mirror 28 can be suppressed.

Note that, in the above second embodiment is described an example in which the dot size determination unit 312 adjusts the dot size when the respective reflecting surfaces 282 of the polygon mirror 28 have an optical face tangle error. Besides this optical face tangle error, the rotary shaft 281 may be tilted by vibration during high-speed rotation of the polygon mirror 28 and a phenomenon similar to the optical face tangle error may occur. Accordingly, vibration during high-speed rotation of the polygon mirror 28 is measured before shipment from the factory of the image forming apparatus 1 and deviation amounts and deviation directions in the sub scanning direction of lines formed by light reflected by the respective reflecting surfaces 282 are measured and stored in the optical face tangle error information storage unit 313 in the occurrence of the optical face tangle error caused by vibration. In performing image formation by rotating the polygon mirror 28 at a high speed, the dot size determination unit 312 reads the optical face tangle error information from the optical face tangle error information storage unit 313 and determines the dot size of each line. This can suppress image quality deterioration even if vibration is generated during high-speed rotation of the polygon mirror 28.

As described above, according to the second embodiment, the dot size determination unit 312 determines the dot size of each line based on the optical face tangle error information of the polygon mirror 28, whereby image quality deterioration due to a line pitch disarray in the sub scanning direction caused by the optical face tangle error can be reduced.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image bearing member on the circumferential surface of which an electrostatic latent image is to be formed;

a data conversion unit for converting input image data into dot image data in which pixel values having gradation information are arranged in a matrix;

a light source for emitting light modulated according to the pixel values for each line of the dot image data to form the electrostatic latent image on the circumferential surface of the image bearing member;

a deflecting mechanism including a rotary polyhedron having a plurality of reflecting surfaces for reflecting light emitted from the light source and a driving member for driving and rotating the rotary polyhedron and adapted to scan the light emitted from the light source in a main scanning direction on the circumferential surface of the image bearing member by driving and rotating the rotary polyhedron by the driving member;

a storage unit for storing optical face tangle error information of each reflecting surface of the rotary polyhedron;

an assignment unit for assigning a number to each of the plurality of reflecting surfaces, specifying by which of the plurality of reflecting surfaces light emitted for each line of the dot image data is to be reflected and assigning the number of the reflecting surface to each line of the dot image data;

a determination unit for determining to the writing timing of each of the dot image data based on the optical face tangle error information, the number of the reflecting surface and the pixel values of the dot image data; and an exposure control unit for causing the light source to emit light in accordance with the determined writing timing, wherein the determination unit:

specifies, out of the respective reflecting surfaces, one reflecting surface and the reflecting surface one before the one reflecting surface, an interval in a sub scanning direction between spots of light reflected by which on the circumferential surface of the image bearing member is wider or narrower than a predetermined reference pitch from the optical face tangle error information; and determines the writing timing of the line of the dot image data to which the number of the specified reflecting surface is assigned based on the pixel values of this line and the pixel values on the line one above this line, successively sets a target pixel for non-white pixels for one line of the dot image data to which the number of the specified reflecting surface is assigned;

increments a first count number when a pitch between the one line and the line one above the one line is wider than the reference pitch and increments a second count number when this pitch is narrower than the reference pitch if a pixel right above and a pixel at the upper right side are white and a pixel at the upper left side is non-white when viewed from the target pixel in data indicated by the line one above the one line;

increments the second count number when the pitch between the one line and the line one above the one line is wider than the reference pitch and increments the first count number when this pitch is narrower than the reference pitch if the pixel right above and the pixel at the upper left side are white and the pixel at the upper right side is non-white when viewed from the target pixel; and determines to relatively advance the writing timing of the one line with respect to the line one above by a predetermined time when the first count number is larger than the second count number and to relatively delay the writing timing of the one line with respect to the line one above by a predetermined time when the second count number is larger than the first count number.

2. The image forming apparatus according to claim 1, wherein, when t denotes the predetermined time, the determination unit advances the writing timing of the one line with respect to the line one above by t/2 while delaying the writing timing of the line one above with respect to the one line by t/2 when the first count number is larger than the second count number, and delays the writing timing of the one line with respect to the line one above by t/2 while advancing the writing timing of the line one above with respect to the one line by t/2 when the second count number is larger than the first count number.

3. An image forming apparatus, comprising:

an image bearing member on the circumferential surface of which an electrostatic latent image is to be formed;

a data conversion unit for converting input image data into dot image data in which pixel values having gradation information are arranged in a matrix;

a light source for emitting light modulated according to the pixel values for each line of the dot image data to form the electrostatic latent image on the circumferential surface of the image bearing member;

a deflecting mechanism including a rotary polyhedron having a plurality of reflecting surfaces for reflecting light emitted from the light source and a driving member for driving and rotating the rotary polyhedron and adapted to scan the light emitted from the light source in a main scanning direction on the circumferential surface of the image bearing member by driving and rotating the rotary polyhedron by the driving member;

a storage unit for storing optical face tangle error information of each reflecting surface of the rotary polyhedron;

an assignment unit for assigning a number to each of the plurality of reflecting surfaces, specifying by which of the plurality of reflecting surfaces light emitted for each line of the dot image data is to be reflected and assigning the number of the reflecting surface to each line of the dot image data;

a determination unit for determining for determining the size of dots formed on the image bearing member by light emitted from the light source for each line of the dot image data; and an exposure control unit for causing the light source to emit light to form dots of the determined dot size, wherein, the determination unit:

specifies, out of the respective reflecting surfaces, one reflecting surface and the reflecting surface one before the former reflecting surface, an interval in a sub scanning direction between spots of light reflected by which on the circumferential surface of the image bearing member is wider or narrower than a predetermined reference pitch from the optical face tangle error information;

determines making the size of the dots larger than a normal dot size when the wider reflecting surface is specified, determines making the size of the dots smaller than a normal dot size when the narrower reflecting surface is specified, and wherein, when D denotes a predetermined value, the determination unit:

makes the size of the dots on the line and the line one above to which the numbers of the reflecting surfaces causing the pitch wider than the reference pitch larger than the normal dot size by D/2 when the determination unit determines to make the size of the dots larger; and makes the size of the dots on the line and the line one above to which the numbers of the reflecting surfaces causing the pitch narrower than the reference pitch smaller than the normal dot size by D/2 when the determination unit determines to make the size of the dots smaller.

4. An exposure method for forming an electrostatic latent image on the circumferential surface of an image bearing member using a rotary polyhedron having a plurality of reflecting surfaces for reflecting light emitted from a light source, comprising the steps of:

converting image data into dot image data in which pixel values having gradation information are arranged in a matrix;

assigning a number to each of the plurality of reflecting surfaces, specifying by which of the plurality of reflecting surfaces light emitted for each line of the dot image data is to be reflected and assigning the number of the reflecting surface to each line of the dot image data;

obtaining optical face tangle error information of each reflecting surface of the rotary polyhedron;

determining the writing timing of each line of the dot image data based on the optical face tangle error information, the number of the reflecting surface and the pixel values of the dot image data; and causing the light source to emit light in accordance with the determined writing timing and scanning the light emitted by the light source in a main scanning direction on the circumferential surface of the image bearing member by rotating the rotary polyhedron, wherein, in determining the emission mode:

out of the respective reflecting surfaces, one reflecting surface and the reflecting surface one before the one reflecting surface, an interval in a sub scanning direction between spots of light reflected by which on the circumferential surface of the image bearing member is wider or narrower than a predetermined reference pitch are specified from the optical face tangle error information; and the writing timing of the line of the dot image data to which the number of the specified reflecting surface is assigned is determined based on the pixel values of this line and the pixel values on the line one above this line, and wherein:

a target pixel is successively set for non-white pixels for one line of the image data to which the number of the specified reflecting surface is assigned;

a first count number is incremented when a pitch between the one line and the line one above the one line is wider than the reference pitch and a second count number is incremented when this pitch is narrower than the reference pitch if a pixel right above and a pixel at the upper right side are white and a pixel at the upper left side is non-white when viewed from the target pixel in data indicated by the line one above the one line;

the second count number is incremented when the pitch between the one line and the line one above the one line is wider than the reference pitch and the first count number is incremented when this pitch is narrower than the reference pitch if the pixel right above and the pixel at the upper left side are white and the pixel at the upper right side is non-white when viewed from the target pixel; and it is determined to advance the writing timing of the one line by a predetermined time from a normal writing timing when the first count number is larger than the second count number and delay the writing timing of the one line by a predetermined time from the normal writing timing when the second count number is larger than the first count number.

* * * * *